US012516864B2

(12) United States Patent
Liu et al.

(10) Patent No.: US 12,516,864 B2
(45) Date of Patent: Jan. 6, 2026

(54) REFRIGERATOR AND ANTI-CONDENSATION METHOD THEREFOR

(71) Applicant: BSH Hausgeräte GmbH, Munich (DE)

(72) Inventors: Xiangyu Liu, Nanjing (CN); Yong Tian, Nanjing (CN); Qiwu Zhu, Chuzhou (CN); Weizhong Zhu, Chuzhou (CN)

(73) Assignee: BSH Hausgeräte GmbH, Munich (DE)

( * ) Notice: Subject to any disclaimer, the term of this patent is extended or adjusted under 35 U.S.C. 154(b) by 77 days.

(21) Appl. No.: 18/579,592

(22) PCT Filed: Jul. 7, 2022

(86) PCT No.: PCT/EP2022/068841
§ 371 (c)(1),
(2) Date: Jan. 16, 2024

(87) PCT Pub. No.: WO2023/285259
PCT Pub. Date: Jan. 19, 2023

(65) Prior Publication Data

US 2024/0318892 A1 Sep. 26, 2024

(30) Foreign Application Priority Data

Jul. 15, 2021 (CN) ..... 202110799008.9

(51) Int. Cl.
*F25D 21/04* (2006.01)

(52) U.S. Cl.
CPC ..... *F25D 21/04* (2013.01)

(58) Field of Classification Search
CPC .. F25D 21/04; F25D 2321/1413; F25D 21/08; F25D 21/004; F25B 2600/0251
See application file for complete search history.

(56) References Cited

U.S. PATENT DOCUMENTS

2018/0238603 A1 8/2018 Takami et al.
2020/0224953 A1* 7/2020 Park ..... F25D 17/045
2020/0224955 A1* 7/2020 Park ..... F25D 17/06

FOREIGN PATENT DOCUMENTS

JP 2013072595 A 4/2013
JP 2013200082 A 10/2013
(Continued)

*Primary Examiner* — Lionel Nouketcha
(74) *Attorney, Agent, or Firm* — Laurence A. Greenberg; Werner H. Stemer; Ralph E. Locher

(57) ABSTRACT

A refrigerator and an anti-condensation method for the refrigerator. The refrigerator includes a first storage compartment, a second storage compartment adjacent the first storage compartment, a separation wall separating the first storage compartment and the second storage compartment, and a heater in the separation wall. The first storage compartment is adapted to be set at a refrigerating temperature, and the second storage compartment is adapted to be set at a freezing temperature. In the anti-condensation method, the heater is controlled to work in an anti-condensation mode when a refrigeration system stops cooling the first storage compartment, to heat a surface of the separation wall facing the first storage compartment, which can significantly reduce the probability of condensation on the surface and is beneficial to reduce the impact of the working of the heater on the refrigeration system.

16 Claims, 6 Drawing Sheets

(56) References Cited

FOREIGN PATENT DOCUMENTS

| | | | |
|---|---|---|---|
| KR | 20060068767 | A | 6/2006 |
| KR | 20120044560 | A | 5/2012 |
| WO | 2016117942 | A1 | 7/2016 |

* cited by examiner

REFRIGERATOR AND ANTI-CONDENSATION METHOD THEREFOR

TECHNICAL FIELD

The present invention relates to the field of electric appliances, and in particular, to a refrigerator and an anti-condensation method therefor.

BACKGROUND

A refrigerator generally includes storage compartments having different storage temperature zones. For example, the refrigerator may include a refrigerating compartment adapted to refrigerate food at a temperature above zero degrees and a freezing compartment adapted to freeze food at a freezing temperature. When the refrigerating compartment and freezing compartment are adjacent, condensation may appear on adjacent surfaces of the refrigerating compartment and freezing compartment under some conditions.

When the refrigerator has a variable-temperature compartment including a variable temperature zone of a freezing temperature and a refrigerating temperature, if the variable-temperature compartment is set at the freezing temperature, condensation may appear in a separation wall between the variable-temperature compartment and the refrigerating compartment; and if the variable-temperature compartment is set at the refrigerating temperature, condensation may appear in a separation wall between the variable-temperature compartment and the freezing compartment.

SUMMARY

An objective of the embodiments of the present invention is to provide an improved refrigerator and an anti-condensation method therefor.

An embodiment of the present invention provides an anti-condensation method for a refrigerator. The refrigerator includes a first storage compartment, a second storage compartment adjacent to the first storage compartment, a separation wall for separating the first storage compartment and the second storage compartment, and a heater located in the separation wall. The first storage compartment is adapted to be set at a refrigerating temperature, and the second storage compartment is adapted to be set at a freezing temperature. The anti-condensation method includes: controlling the heater to work in an anti-condensation mode when a refrigeration system stops cooling the first storage compartment, to heat a surface of the separation wall facing the first storage compartment.

Optionally, the method further includes: when a set temperature of the first storage compartment is greater than a first preset value or a detected temperature of the first storage compartment is greater than a second preset value, controlling the heater to work in the anti-condensation mode when the refrigeration system stops cooling the first storage compartment, to heat the surface of the separation wall facing the first storage compartment.

Optionally, the method further includes: when a first difference between a set temperature of the first storage compartment and a set temperature of the second storage compartment is greater than a third preset value or a second difference between a detected temperature of the first storage compartment and a detected temperature of the second storage compartment is greater than a fourth preset value, controlling the heater to work in the anti-condensation mode when the refrigeration system stops cooling the first storage compartment, to heat the surface of the separation wall facing the first storage compartment.

Optionally, the method further includes: obtaining an operating rate of the first storage compartment; and when the operating rate is less than a fifth preset value, controlling the heater to work in the anti-condensation mode when the refrigeration system stops cooling the first storage compartment, to heat the surface of the separation wall facing the first storage compartment.

Optionally, the method further includes: obtaining a frequency at which a door of the first storage compartment is opened; and when the frequency is greater than a sixth preset value, controlling the heater to work in the anti-condensation mode when the refrigeration system stops cooling the first storage compartment, to heat the surface of the separation wall facing the first storage compartment.

Optionally, the method further includes: controlling, in the anti-condensation mode, the heater to work intermittently to heat the surface of the separation wall facing the first storage compartment.

Optionally, the method further includes: after the refrigeration system stops cooling the first storage compartment, starting working of the heater after a wait duration.

Optionally, in the anti-condensation mode, a waiting duration, an operating duty cycle, and/or an output power of the heater are determined according to at least one of the set temperature of the first storage compartment, the detected temperature of the first storage compartment, the first difference between the set temperature of the first storage compartment and the set temperature of the second storage compartment, the second difference between the detected temperature of the first storage compartment and the detected temperature of the second storage compartment, an ambient temperature around the refrigerator, and an ambient humidity around the refrigerator.

Optionally, the method further includes: determining the waiting duration, the operating duty cycle, and/or the output power of the heater based on a temperature difference range within which the first difference or the second difference falls.

Optionally, the method further includes: dividing the temperature difference range into a plurality of temperature difference sub-ranges; and determining the waiting duration of the heater based on a temperature difference sub-range within which the first difference or the second difference falls, where a temperature difference sub-range with a higher temperature difference corresponds to a shorter waiting duration of the heater than a temperature difference sub-range with a lower temperature difference.

Optionally, the method further includes: dividing the temperature difference range into a plurality of temperature difference sub-ranges; and determining the operating duty cycle and/or the output power of the heater based on a temperature difference sub-range within which the first difference or the second difference falls, where a temperature difference sub-range with a higher temperature difference corresponds to a higher operating duty cycle and/or a higher output power of the heater than a temperature difference sub-range with a lower temperature difference.

Optionally, the method further includes: determining the waiting duration, the operating duty cycle, and/or the output power of the heater based on an ambient temperature range within which the ambient temperature falls or an ambient humidity range within which the ambient humidity falls.

Optionally, the method further includes: dividing the ambient temperature range into a plurality of ambient temperature sub-ranges; and determining the waiting duration of the heater based on an ambient temperature sub-range within which the ambient temperature falls, where an ambient temperature sub-range with a higher temperature corresponds to a longer waiting duration of the heater than an ambient temperature sub-range with a lower temperature.

Optionally, the method further includes: dividing the ambient temperature range into a plurality of ambient temperature sub-ranges; and determining the operating duty cycle and/or the output power of the heater based on an ambient temperature sub-range within which the ambient temperature falls, where an ambient temperature sub-range with a higher temperature corresponds to a lower operating duty cycle and/or a lower output power of the heater than an ambient temperature sub-range with a lower temperature.

Optionally, the ambient temperature sub-range is greater than or equal to a first temperature and less than or equal to a second temperature, and the anti-condensation method includes: if the ambient temperature is greater than or equal to a difference of the first temperature minus a buffer value and less than or equal to a sum of the second temperature plus the buffer value, determining that the ambient temperature is within the ambient temperature sub-range, the buffer value being greater than or equal to 0° C.

Optionally, the method further includes: dividing the ambient humidity range into a plurality of ambient humidity sub-ranges; and determining the waiting duration of the heater based on an ambient humidity sub-range within which the ambient humidity falls, where an ambient humidity sub-range with a higher humidity corresponds to a shorter waiting duration of the heater than an ambient humidity sub-range with a lower humidity.

Optionally, the method further includes: dividing the ambient humidity range into a plurality of ambient humidity sub-ranges; and determining the operating duty cycle and/or the output power of the heater based on an ambient humidity sub-range within which the ambient humidity falls, where an ambient humidity sub-range with a higher humidity corresponds to a higher operating duty cycle and/or a higher output power of the heater than an ambient humidity sub-range with a lower humidity.

An embodiment of the present invention further provides a refrigerator, including: a first storage compartment, having a settable temperature range including a refrigerating temperature; a second storage compartment, adjacent to the first storage compartment and having a settable temperature range including a freezing temperature; a separation wall, configured to separate the first storage compartment and the second storage compartment; a refrigeration system, configured to cool at least the first storage compartment; a heater, located in the separation wall; and a controller, adapted to perform any one of the foregoing anti-condensation methods.

Optionally, the first storage compartment is a variable-temperature compartment, and the second storage compartment is a freezing compartment; or the first storage compartment is a refrigerating compartment, and the second storage compartment is a freezing compartment or a variable-temperature compartment.

Compared with the related art, the technical solutions of the embodiments of the present invention have the following beneficial effects. For example, the technical solutions of the embodiments of the present invention include: controlling the heater to work in the anti-condensation mode when the refrigeration system stops cooling the first storage compartment, to heat the surface of the separation wall facing the first storage compartment. In this way, the temperature of the surface of the separation wall facing the first storage compartment can be increased, so that the probability of condensation on the surface can be significantly reduced. In addition, the surface of the separation wall is heated when the refrigeration system stops cooling the first storage compartment, which is beneficial to reduce the impact of the working of the heater on the refrigeration system.

Additional features of the present invention are presented from the claims, the drawings, and the description of the drawings. The features and feature combinations described in the foregoing description and the features and feature combinations described in the following description of the drawings and/or briefly shown in the drawings may not only be presented respectively in the described combinations, but also be presented in other combinations or separately without departing from the scope of the present invention. Embodiments of the present invention which are not described and not specifically shown in the drawings, but may be conceived from the embodiments described in detail and may be obtained from combinations of the various features are hereby considered to be included and disclosed.

DETAILED DESCRIPTION

To make the objectives, features, and beneficial effects of the present invention more comprehensible, the specific implementations of the present invention are described in detail below with reference to the accompanying drawings.

An embodiment of the present invention provides a refrigerator.

In a specific implementation, the refrigerator may include two or more storage compartments independent of each other in space. In any two adjacent storage compartments, if one of the two storage compartments has a settable temperature range including a refrigerating temperature, and the other has a settable temperature range including a freezing temperature, the former may be referred to as a first storage compartment, and the latter may be referred to as a second storage compartment.

The refrigerating temperature may be greater than 0° C. For example, the refrigerating temperature may be in a temperature range from greater than 0° C. to less than or equal to 12° C.

The freezing temperature is lower than 0° C. For example, the freezing temperature may be in a temperature range from greater than or equal to −20° C. to less than 0° C.

Figure 1:
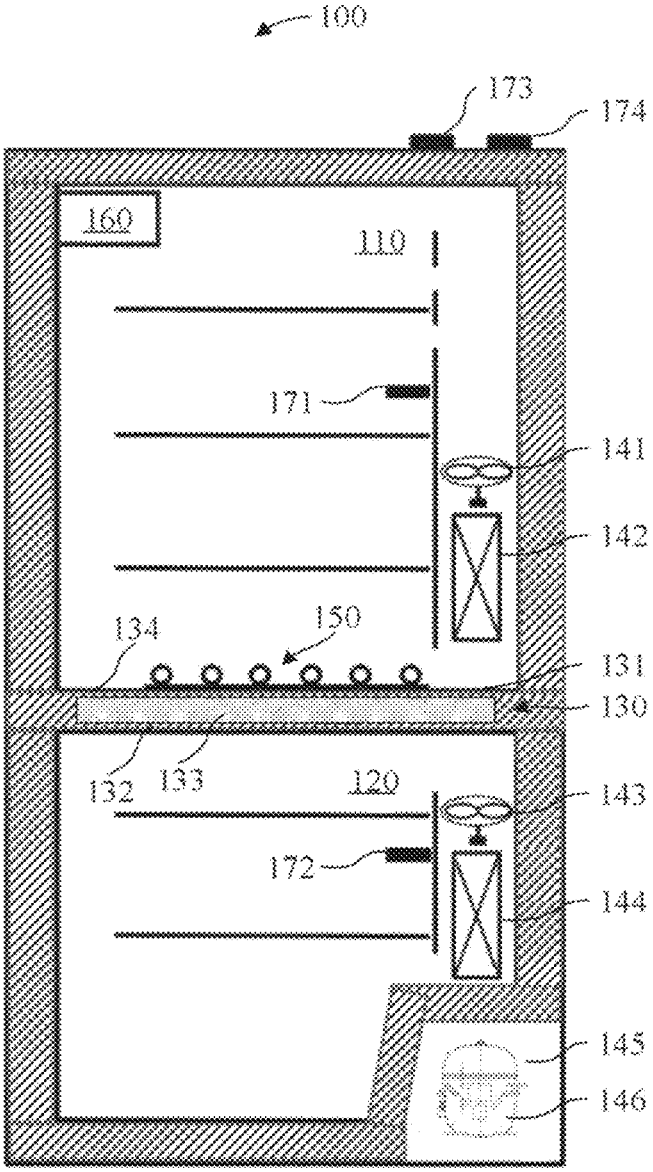
FIG. 1 is a schematic diagram of a refrigerator according to an embodiment of the present invention.

As shown in FIG. 1, a refrigerator 100 includes a first storage compartment 110 and a second storage compartment 120.

In some embodiments, the first storage compartment 110 is a variable-temperature compartment, and the second storage compartment 120 is a freezing compartment.

In some other embodiments, the first storage compartment 110 is a refrigerating compartment, and the second storage compartment 120 is a freezing compartment or a variable-temperature compartment.

The refrigerator 100 may further include a separation wall 130, a refrigeration system, a heater 150, and a controller 160.

The separation wall 130 is configured to reduce heat exchange between the first storage compartment 110 and the second storage compartment 120. The separation wall 130 may include a first wall 134 facing the first storage compartment 110, a second wall 132 facing the second storage compartment 120, and a thermal insulation material 133 sandwiched between the first wall 134 and the second wall 132. The thermal insulation material 133 may be formed by foaming between the first wall 134 and the second wall 132 or placed between the first wall 134 and the second wall 132 after being separately manufactured.

The separation wall 130 may be arranged in a horizontal direction to separate the first storage compartment 110 and the second storage compartment 120 adjacent to each other horizontally. The separation wall 130 may alternatively be arranged in a vertical direction to separate the first storage compartment 110 and the second storage compartment 120 adjacent to each other vertically.

The refrigeration system may include a compressor 146, a condenser, and at least one evaporator 142, 144, which are connected by a refrigerating pipeline to circulate refrigerants in a refrigeration circuit. The refrigerants are evaporated in the at least one evaporator 142, 144 to input cooling air to the corresponding storage compartments.

The refrigeration system may further include fans 141, 143 arranged adjacent to the at least one evaporator 142, 144, so that air cooled by the at least one evaporator 142, 144 is forcibly inputted to a storage region of the first storage compartment 110 or the second storage compartment 120.

Figure 6:
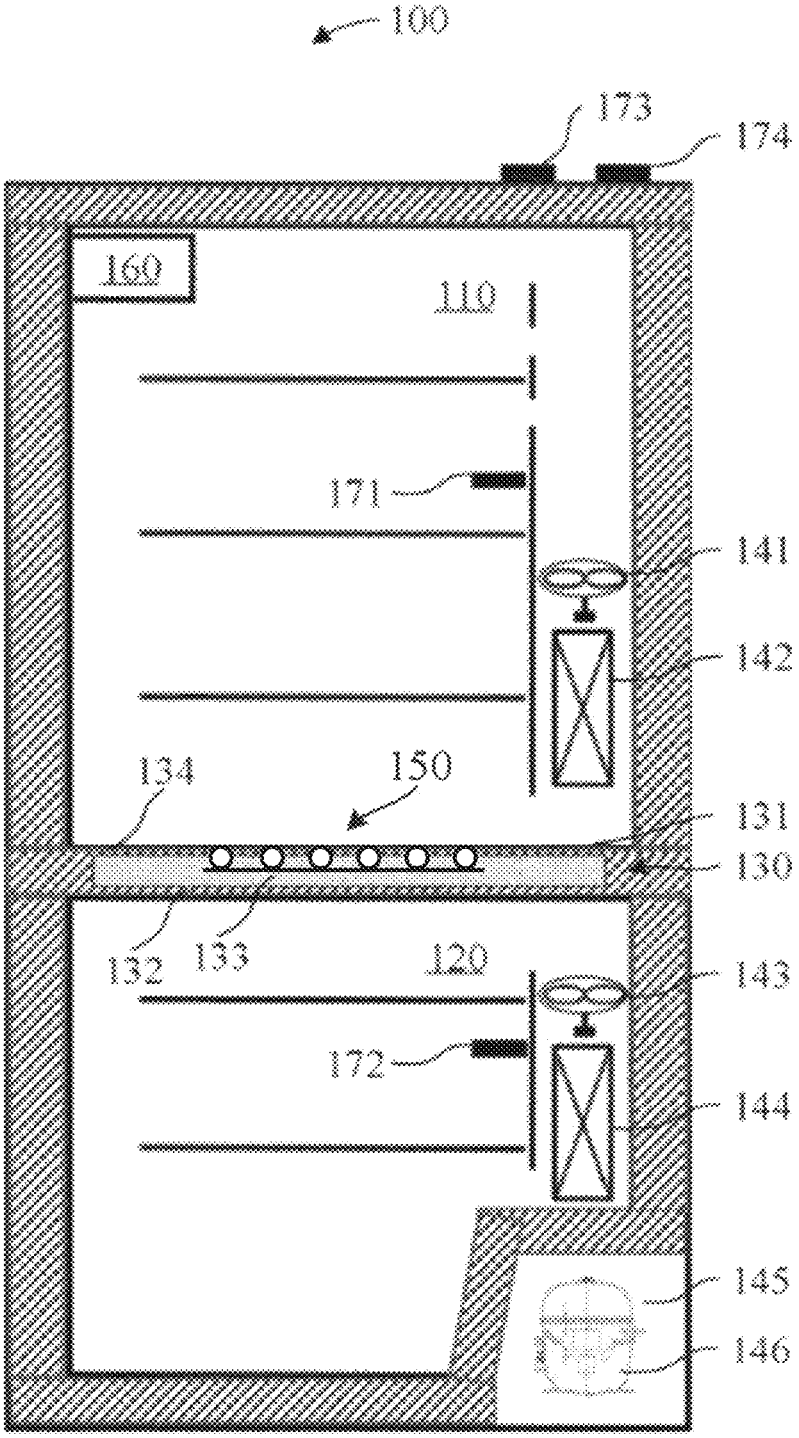
FIG. 6 is a schematic diagram of a refrigerator according to an embodiment of the present invention.

As shown in FIG. 6, heater 150 may be arranged inside the separation wall 130. The heater 150 may alternatively be arranged against an inner surface of the first wall 134 to apply heat to the first wall 134, to increase the efficiency of heating a surface requiring anti-condensation.

The controller 160 is adapted to control working of the heater 150 and the compressor 146.

The refrigerator 100 may include an input unit. A user may set, by using the input unit, set temperatures of the first storage compartment 110 and the second storage compartment 120. The set temperatures are temperatures that the user wants the corresponding storage compartments to reach.

The refrigerator 100 may further include a first temperature sensor 171 in the first storage compartment 110, a second temperature sensor 172 in the second storage compartment 120, and an ambient temperature sensor 173 and an ambient humidity sensor 174 at a housing of the refrigerator 100.

The first temperature sensor 171 and the second temperature sensor 172 are configured to detect temperatures of the first storage compartment 110 and the second storage compartment 120 respectively. The controller 160 controls the compressor 143 and the fan 143 based on the set temperatures of the corresponding storage compartments, or the temperatures measured by the first temperature sensor 171 and the second temperature sensor 172.

In an embodiment, the controller 160 determines a startup temperature and a shutdown temperature of the first storage compartment 110 according to the set temperature of the first storage compartment 110, that is, when the temperature of the first storage compartment 110 is higher than or rises to the startup temperature of the first storage compartment, the first storage compartment 110 has a refrigeration demand, and the controller 160 controls the refrigeration system to cool the first storage compartment 110. When the temperature of the first storage compartment 110 is lowered to the shutdown temperature of the first storage compartment, the refrigeration demand of the first storage compartment 110 is satisfied, and the refrigeration system stops cooling the first storage compartment 110.

The ambient temperature sensor 173 and the ambient humidity sensor 174 are configured to detect an ambient temperature and an ambient humidity around the refrigerator 100 respectively.

Figure 2:
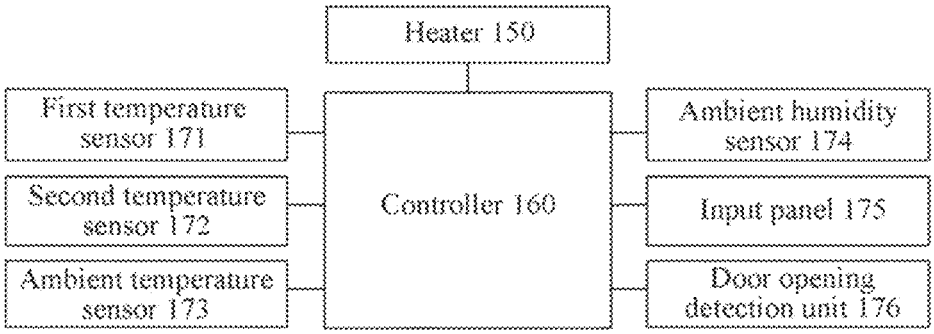
FIG. 2 is a schematic diagram of a connection between a controller and a heater, a temperature sensor, a humidity sensor, an input panel, and a door opening detection unit according to an embodiment of the present invention.

As shown in FIG. 2, the controller 160 may be connected to the heater 150, the first temperature sensor 171, the second temperature sensor 172, the ambient temperature sensor 173, and the ambient humidity sensor 174 respectively.

The controller 160 is adapted to control the heater 150 to work in an anti-condensation mode when the refrigeration system stops cooling the first storage compartment 110, to heat a surface 131 of the separation wall 130 facing the first storage compartment 110.

When the refrigeration demand of the first storage compartment 110 is satisfied, the refrigeration system stops cooling the first storage compartment 110. For example, the compressor stops working, supplying of the refrigerant to the refrigeration circuit for cooling the first storage compartment 110 is stopped, and/or an air duct for supplying cold air to the first storage compartment 110 is closed.

In the period when the refrigeration system stops cooling the first storage compartment 110, the temperature of the first storage compartment 110 slowly rises. In this period, the first wall 134 of the separation wall 130 is heated by the heater 150, and the temperature of the surface 131 facing the first storage compartment 110 is increased along with the rise of the temperature of the first storage compartment 110, which is conducive to reducing the probability of condensation, and does not significantly affect the working of the refrigeration system. In the related art, to improve the working time of the refrigeration system for the first storage compartment 110, when the refrigeration system cools the first storage compartment 110, the heater 150 works to exchange cold air in an evaporator compartment with air in the first storage compartment 110 to prevent condensation. In contrast, the present invention has a significant technical advantage of energy saving.

In some embodiments, the heater 150 may be arranged only for anti-condensation, and is thus adapted to work in the anti-condensation mode. In some other embodiments, the heater 150 may further work in other modes in addition to being adapted to work in the anti-condensation mode. For example, the heater may work in a compensation heating mode, so that the first storage compartment 110 is heated to a set temperature.

In some embodiments, the controller 160 controls, in the anti-condensation mode, the heater 150 to work intermittently to heat the surface 131 of the separation wall 130 facing the first storage compartment 110. In this way, the first wall 134 may alternate between being heated by the heater 150 and being cooled by cooling air from the second storage compartment 120. Therefore, it is possible that the heat of the heater 150 can be retained near the first wall 134 without significantly entering the storage region of the first storage compartment 110.

In some embodiments, when the refrigeration system stops cooling the first storage compartment 110, the heater 150 works to operate the anti-condensation mode after a waiting duration ends. When the cold air in the evaporator compartment and the air in the first storage compartment 110 form an air circulation, moist air in the first storage compartment 110 can be taken away. When the refrigeration system stops cooling the first storage compartment 110, the humidity in the first storage compartment 110 may slowly rise. The heater 150 is operated after a waiting duration, which can prevent condensation in a more targeted manner, and is beneficial to reduce the impact of the heater 150 on the energy consumption of the refrigerator 100.

The waiting duration may be adjusted based on at least one parameter (for example, the ambient temperature).

The controller 160 may determine a waiting duration, an operating duty cycle, and/or an output power of the heater 150.

The controller 160 may be connected to the first temperature sensor 171 to receive information about a detected temperature of the first storage compartment 110, and may send control information to the heater 150 based on the detected temperature, to cause the heater to work in the anti-condensation mode when the refrigeration system stops cooling the first storage compartment 110, to heat the surface 131 of the separation wall 130 facing the first storage compartment.

The controller 160 may be further connected to the second temperature sensor 172 to receive information about a detected temperature of the second storage compartment 120, and may send control information to the heater 150 based on a difference between the detected temperature of the first storage compartment 110 and the detected temperature of the second storage compartment 120, to cause the heater to work in the anti-condensation mode when the refrigeration system stops cooling the first storage compartment 110, to heat the surface 131 of the separation wall 130 facing the first storage compartment 110.

The controller 160 may further determine the waiting duration, the operating duty cycle, and/or the output power of the heater 150 based on a temperature difference sub-range within which the difference between the detected temperature of the first storage compartment 110 and the detected temperature of the second storage compartment 120 falls, and then send control information to the heater 150 based on the waiting duration, the operating duty cycle, and/or the output power, to cause the heater to work in the anti-condensation mode when the refrigeration system stops cooling the first storage compartment 110, to heat the surface 131 of the separation wall 130 facing the first storage compartment 110.

The controller 160 may be connected to the ambient temperature sensor 173 to receive information about an ambient temperature around the refrigerator 100, determine the waiting duration, the operating duty cycle, and/or the output power of the heater 150 based on an ambient temperature sub-range within which the ambient temperature falls, and then send control information to the heater 150 based on the waiting duration, the operating duty cycle, and/or the output power, to cause the heater to work in the anti-condensation mode when the refrigeration system stops cooling the first storage compartment 110, to heat the surface 131 of the separation wall 130 facing the first storage compartment 110.

The controller 160 may be connected to the ambient humidity sensor 174 to receive information about an ambient humidity around the refrigerator 100, determine the waiting duration, the operating duty cycle, and/or the output power of the heater 150 based on an ambient humidity sub-range within which the ambient humidity falls, and then send control information to the heater 150 based on the waiting duration, the operating duty cycle, and/or the output power, to cause the heater to work in the anti-condensation mode when the refrigeration system stops cooling the first storage compartment 110, to heat the surface 131 of the separation wall 130 facing the first storage compartment 110.

The controller 160 may automatically set or calculate an operating rate of the first storage compartment, and may send control information to the heater 150 based on the operating rate, to cause the heater to work in the anti-condensation mode when the refrigeration system stops cooling the first storage compartment 110, to heat the surface 131 of the separation wall 130 facing the first storage compartment.

The refrigerator 100 may further include a door opening detection unit 176, to detect whether a door of the first storage compartment 110 is opened or closed, and a quantity of times and/or a frequency at which the door is opened or closed.

The controller 160 may be connected to the door opening detection unit 176 to obtain information about the frequency at which the door of the first storage compartment 110 is opened or closed.

For example, the door opening detection unit 176 generates a signal that the door is opened or closed based on the opening or closing of the door, and sends the signal to the controller 160; and the controller 160 receives the signal and counts a quantity of signals per unit time, thereby calculating the information about the frequency at which the door is opened or closed.

In another example, the door opening detection unit 176 counts a quantity of times the door is opened or closed per unit time to calculate a frequency at which the door is opened or closed, and sends information about the frequency to the controller 160; and the controller 160 receives the information about the frequency.

The controller 160 may send control information to the heater 150 based on the frequency, to cause the heater to work in the anti-condensation mode when the refrigeration system stops cooling the first storage compartment 110, to heat the surface 131 of the separation wall 130 facing the first storage compartment 110.

Figure 3:
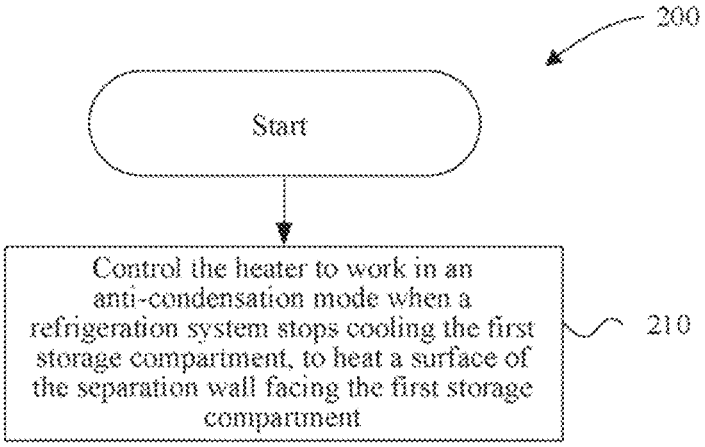
FIG. 3 is an overall flowchart of an anti-condensation method for a refrigerator according to an embodiment of the present invention.

For a specific implementation of the controller 160, reference may also be made to the following description of a method for a refrigerator with reference to FIG. 3.

An embodiment of the present invention further provides a method for the refrigerator 100 described above.

The separation wall 130 between the first storage compartment 110 and the second storage compartment 120 in the refrigerator 100 has a thermal insulation material to separate the two storage compartments and has functions of heat preservation and thermal insulation. There may be a large temperature difference between one side of the separation wall 130 facing the first storage compartment 110 and the other side facing the second storage compartment 120, so that there is heat exchange, making the surface 131 of the separation wall 130 facing the first storage compartment 110 have a lower temperature than the existing air in the first storage compartment 110.

When the refrigeration system is in a refrigeration stage of cooling the first storage compartment 110, the humidity of the cold air supplied to the first storage compartment 110 is relatively low compared to the humidity of the existing air in the first storage compartment 110. As a result, the humidity of the air in the first storage compartment 110 is lowered, so that condensation is not easy to occur.

When the refrigeration system is in a non-refrigeration stage of stopping cooling the first storage compartment 110, the humidity of the air in the first storage compartment 110 gradually rises. After the air with a relatively high temperature and relatively high humidity comes into contact with the separation wall 130 with a relatively low temperature (for example, the surface 131 facing the first storage compartment 110), condensation is easy to occur.

A solution of arranging a humidity sensor in the first storage compartment 110 to detect a humidity state increases costs, and controlling the heating of the heater 150 based on a humidity detected by the humidity sensor cannot achieve effective heating, and the phenomenon of inability to eliminate condensation and excessive heating is likely to occur.

In an embodiment of the present invention, as shown in FIG. 3, an overall flowchart 200 of an anti-condensation method for a refrigerator 100 includes step 210.

In the execution of step 210, the heater 150 is controlled to work in the anti-condensation mode when the refrigeration system stops cooling the first storage compartment 110, to heat the surface 131 of the separation wall 130 facing the first storage compartment 110.

The heater 150 is controlled to work in the anti-condensation mode when the refrigeration system stops cooling the first storage compartment 110, which can not only effectively eliminate condensation, but also minimize the output power of the heater 150, thereby saving energy.

Figure 4:
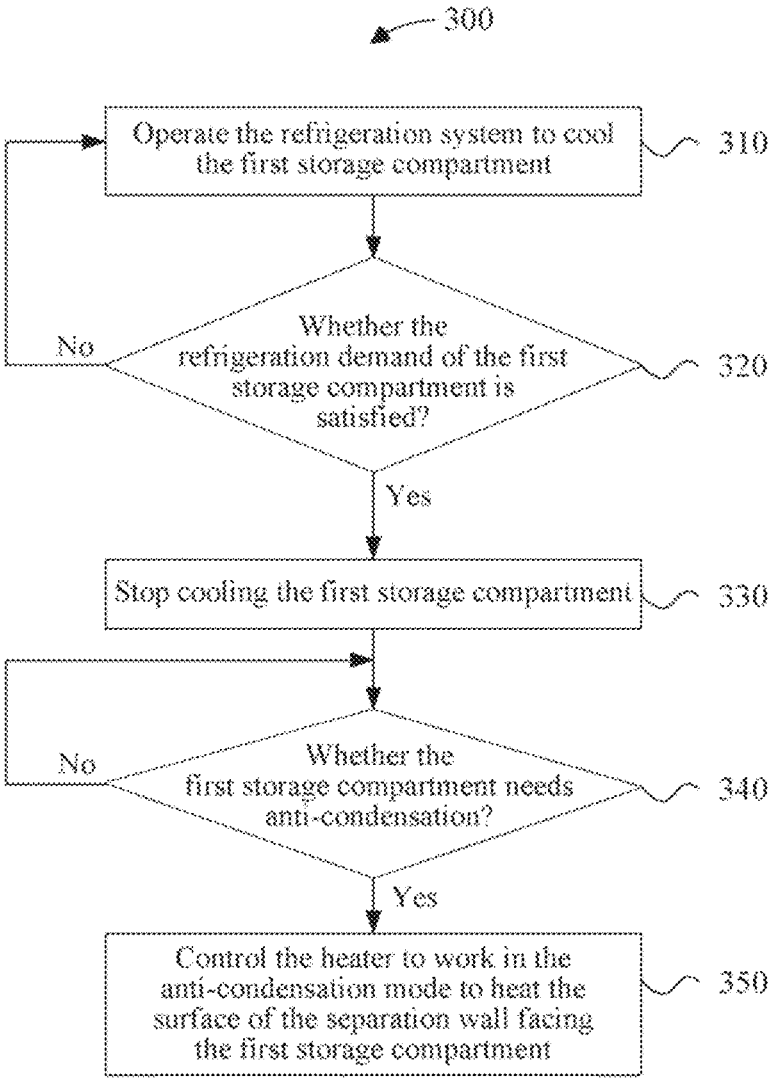
FIG. 4 is a specific flowchart of an anti-condensation method for a refrigerator according to an embodiment of the present invention.

FIG. 4 is a flowchart 300 of a method for a refrigerator 100 according to an embodiment of the present invention. In step 310, the refrigeration system is operated to cool the first storage compartment 110.

In a specific implementation, the temperature in the first storage compartment 110 may be detected by the first temperature sensor 171, and the controller 160 may determine whether the temperature is higher than or increased to the startup temperature of the first storage compartment 110, and if so, it is determined that the first storage compartment 110 has a refrigeration demand, and the refrigeration system is operated to cool the first storage compartment 110. The startup temperature of the first storage compartment 110 may be determined according to the set temperature of the first storage compartment 110.

When the refrigeration system works, the compressor 146 may operate for cooling the first storage compartment 110, supply refrigerants to a refrigeration cycle of the first storage compartment 110, and supply cold air to the first storage compartment 110, thereby cooling the first storage compartment 110.

In step 320, it is determined whether the refrigeration demand of the first storage compartment 110 is satisfied.

In a specific implementation, the temperature in the first storage compartment 110 may be detected by the first temperature sensor 171, and the controller 160 may determine whether the temperature is lowered to the shutdown temperature of the first storage compartment 110, and if so, it is determined that the refrigeration demand of the first storage compartment 110 is satisfied, and step 330 is performed; otherwise the process returns to step 310. The shutdown temperature of the first storage compartment 110 may be determined according to the set temperature of the first storage compartment 110.

In step 330, cooling of the first storage compartment 110 is stopped.

In a specific implementation, after it is determined that the refrigeration demand of the first storage compartment 110 is satisfied, the controller 160 may stop the compressor 146 from operating to cool the first storage compartment 110, stop the supply of the refrigerant to the refrigeration cycle of the first storage compartment 110, and/or stop the fan 141 from supplying cold air to the first storage compartment 110, thereby stopping cooling the first storage compartment 110.

In step 340, it is determined whether the first storage compartment 110 needs anti-condensation.

In a specific implementation, the controller 160 may determine whether the first storage compartment 110 needs anti-condensation based on a signal about starting anti-condensation that is manually inputted from the input panel 175 or relevant conditions.

The heater may work in the anti-condensation mode based on the signal about starting anti-condensation that is manually inputted from the input panel 175. In this way, when the operator of the refrigerator 100 observes that there is condensation on the surface 131 of the separation wall 130 facing the first storage compartment 110 and makes a decision to eliminate the condensation, manual participation can be performed timely, thereby eliminating the condensation in a targeted manner. In addition, the heater 150 may work only when there is manual participation, thereby reducing the power consumed by the refrigerator 100 or the heater 150 and saving energy.

Whether the first storage compartment 110 needs anti-condensation which is determined based on relevant conditions is described below with reference to specific embodiments.

If the first storage compartment 110 needs anti-condensation, step 350 is performed; otherwise the process returns to step 340.

In step 350, the heater 150 is controlled to work in the anti-condensation mode to heat the surface 131 of the separation wall 130 facing the first storage compartment 110.

In this embodiment of the present invention, a relevant condition for determining whether the first storage compartment 110 needs anti-condensation includes: whether the set temperature of the first storage compartment 110 is greater than a first preset value. Whether the first storage compartment 110 needs anti-condensation may be determined based on the condition.

Specifically, when the set temperature of the first storage compartment 110 is greater than the first preset value, it is determined that the first storage compartment 110 needs anti-condensation. The controller 160 may control the heater 150 to work in the anti-condensation mode when the refrigeration system stops cooling the first storage compartment 110, to heat the surface 131 of the separation wall 130 facing the first storage compartment 110.

In some embodiments, the first preset value is selected from a range of 0 to 3° C.

The heater 150 is controlled to work based on the preset set temperature, which can avoid frequent detection of the temperature of the first storage compartment 110 to determine whether anti-condensation is needed, thereby reducing components related to the temperature detection. This not only reduces the equipment costs, but also reduces the complexity of the algorithm implementation.

In this embodiment of the present invention, a relevant condition for determining whether the first storage compartment 110 needs anti-condensation includes: whether the detected temperature of the first storage compartment 110 is greater than a second preset value. Whether the first storage compartment 110 needs anti-condensation may be determined based on the condition.

Specifically, the detected temperature may be obtained based on the temperature sensor 171 arranged in the first storage compartment 110. When the detected temperature of the first storage compartment 110 is greater than the second preset value, it is determined that the first storage compartment 110 needs anti-condensation. The controller 160 may control the heater 150 to work in the anti-condensation mode when the refrigeration system stops cooling the first storage compartment 110, to heat the surface 131 of the separation wall 130 facing the first storage compartment 110.

In some embodiments, the second preset value is selected from a range of 0 to 4° C.

The heater 150 is controlled to work based on the real-time detected temperature, which can prevent the heater 150 from working in a period when the actual temperature of the first storage compartment 110 has not reached the set temperature after the set temperature is set, thereby reducing the working duration of the heater 150 and reducing the operating costs.

In this embodiment of the present invention, a relevant condition for determining whether the first storage compartment 110 needs anti-condensation includes: whether a first difference between a set temperature of the first storage compartment 110 and a set temperature of the second storage compartment 120 is greater than a third preset value. Whether the first storage compartment 110 needs anti-condensation may be determined based on the condition.

Specifically, when the first difference between the set temperature of the first storage compartment 110 and the set temperature of the second storage compartment 120 is greater than the third preset value, it is determined that the first storage compartment 110 needs anti-condensation. The controller 160 may control the heater 150 to work in the anti-condensation mode when the refrigeration system stops cooling the first storage compartment 110, to heat the surface 131 of the separation wall 130 facing the first storage compartment 110.

In some embodiments, the third preset value is selected from a range of 6 to 12° C.

The working of the heater 150 is controlled based on the first difference, and the condensation generated on the surface 131 of the separation wall 130 facing the first storage compartment 110 is associated with the first difference with respect to the set temperatures, so that the heater 150 can be controlled more precisely to work in the anti-condensation mode. In addition, frequent detection of the temperature of the first storage compartment 110 can be avoided, thereby reducing components related to the temperature detection, and reducing the complexity of the algorithm implementation.

In this embodiment of the present invention, a relevant condition for determining whether the first storage compartment 110 needs anti-condensation includes: whether a second difference between the detected temperature of the first storage compartment 110 and the detected temperature of the second storage compartment 120 is greater than a fourth preset value. Whether the first storage compartment 110 needs anti-condensation may be determined based on the condition.

Specifically, the controller 160 may obtain a first detected temperature based on the temperature sensor 171 arranged in the first storage compartment 110, obtain a second detected temperature based on the temperature sensor 172 arranged in the second storage compartment 120, and subtract the second detected temperature from the first detected temperature to obtain the second difference. When the second difference between the detected temperature of the first storage compartment 110 and the detected temperature of the second storage compartment 120 is greater than the fourth preset value, it is determined that the first storage compartment 110 needs anti-condensation. The controller 160 may control the heater 150 to work in the anti-condensation mode in the period when the refrigeration system stops cooling the first storage compartment 110, to heat the surface 131 of the separation wall 130 facing the first storage compartment 110.

In some embodiments, the fourth preset value is selected from a range of 6 to 18° C.

The working of the heater 150 is controlled based on the second difference, and the condensation generated on the surface 131 of the separation wall 130 facing the first storage compartment 110 is associated with the second difference with respect to the detected temperatures, so that the heater 150 can be controlled more precisely to work in the anti-condensation mode. In addition, the heater 150 can be prevented from working when a difference between the actual temperatures of the first storage compartment and the second storage compartment 120 has not reached the first difference after the set temperatures of the first storage compartment and the second storage compartment 120 are set, thereby reducing the working duration of the heater 150 and reducing the operating costs.

In this embodiment of the present invention, a relevant condition for determining whether the first storage compartment 110 needs anti-condensation includes: whether the operating rate of the first storage compartment 110 is less than a fifth preset value. Whether the first storage compartment 110 needs anti-condensation may be determined based on the condition.

The operating rate of the first storage compartment 110 represents a ratio of an operation time of the compressor for cooling the first storage compartment 110 to a sum of the operation time and a shutdown time of the compressor.

Specifically, the operating rate of the first storage compartment 110 may be obtained; and when the operating rate is less than the fifth preset value, it is determined that the first storage compartment 110 needs anti-condensation. The controller 160 may control the heater 150 to work in the anti-condensation mode when the refrigeration system stops cooling the first storage compartment 110, to heat the surface 131 of the separation wall 130 facing the first storage compartment 110.

In some embodiments, the fifth preset value is selected from a range of 5% to 10%.

When the compressor is turned on to cause the first storage compartment 110 to be in a refrigerating state, air with a relatively high humidity in the first storage compartment 110 exchanges air with cold air with a relatively low humidity inputted from the evaporator compartment, so that the humidity of the air in the first storage compartment 110 is lowered, and thus condensation does not occur.

When the operating rate of the first storage compartment 110 is less than the fifth preset value, a duration and/or a frequency at which the first storage compartment 110 is in the refrigerating state is relatively low, and the humidity of the air in the first storage compartment is relatively high, so that condensation may easily occur. Therefore, the working of the heater 150 is controlled based on the operating rate of the first storage compartment 110, which can effectively prevent condensation.

In this embodiment of the present invention, a relevant condition for determining whether the first storage compartment 110 needs anti-condensation includes: whether the frequency at which the door of the first storage compartment 110 is opened or closed is greater than a sixth preset value. Whether the first storage compartment 110 needs anti-condensation may be determined based on the condition.

Specifically, the frequency at which the door of the first storage compartment 110 is opened or closed may be detected by a sensor such as the door opening detection unit, and after the controller 160 obtains the frequency, the frequency is compared with the sixth preset value; and when the frequency is greater than the sixth preset value, it is determined that the first storage compartment 110 needs anti-condensation. The controller 160 may control the heater 150 to work in the anti-condensation mode when the refrigeration system stops cooling the first storage compartment 110, to heat the surface 131 of the separation wall 130 facing the first storage compartment 110.

In some embodiments, the sixth preset value is selected from a range of 3 to 5 times per hour.

The ambient gas around the refrigerator 100 may be high-temperature and/or high-humidity compared with the gas in the first storage compartment 110, and the frequency at which the door of the first storage compartment 110 is opened is related to an amount of the ambient gas entering the first storage compartment 110. When the frequency is greater than the sixth preset value, the amount of the ambient gas entering the first storage compartment 110 is large enough, and the humidity is high enough, so that condensation may easily occur. Therefore, the working of the heater 150 is controlled based on the frequency, which can effectively prevent condensation.

In this embodiment of the present invention, a relevant condition for determining whether the first storage compartment 110 needs anti-condensation includes: whether a waiting duration is reached after the refrigeration system stops cooling the first storage compartment 110. Whether the first storage compartment 110 needs anti-condensation may be determined based on the condition.

Specifically, the waiting duration may be preset, counting is performed when the refrigeration system stops cooling the first storage compartment 110, and the controller 160 compares a counted duration with the waiting duration; and when the counted duration is greater than or equal to the waiting duration, it is determined that the first storage compartment 110 needs anti-condensation. The controller 160 may control the heater 150 to work in the anti-condensation mode when the refrigeration system stops cooling the first storage compartment 110, to heat the surface 131 of the separation wall 130 facing the first storage compartment 110.

Figure 5:
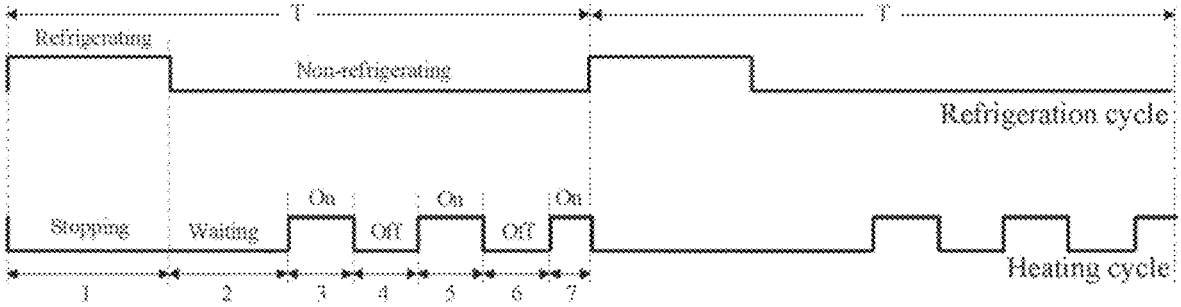
FIG. 5 is a schematic diagram of a refrigeration cycle of a refrigeration system and a heating cycle of a heater according to an embodiment of the present invention.

When the cold air in the evaporator compartment and the air in the first storage compartment 110 form an air circulation, moist air in the first storage compartment 110 can be taken away. When the refrigeration system stops cooling the first storage compartment 110, the humidity in the first storage compartment 110 may slowly rise. The heater 150 is operated after a waiting duration, which can prevent condensation in a more targeted manner, and is beneficial to reduce the impact of the heater 150 on the energy consumption of the refrigerator 100. As shown in FIG. 5, there is a correspondence between a refrigeration cycle of the refrigeration system and a heating cycle of the heater 150.

A description is made below based on one refrigeration cycle (T). In another refrigeration cycle, the refrigeration system and the heater 150 have the same or similar working principles, and there is a same or similar correspondence between the refrigeration cycle and the heating cycle.

A refrigeration cycle includes a refrigeration stage and a non-refrigeration stage.

In the refrigeration stage, the compressor operates for cooling the first storage compartment 110, supplies refrigerants to a refrigeration cycle of the first storage compartment 110, and supplies cold air to the first storage compartment 110. In this case, the heater 150 is in a non-working state. The refrigeration stage is illustrated as "Refrigerating" and "Stopping" of stage 1 in FIG. 5.

In the non-refrigeration stage, the compressor stops operating for cooling the first storage compartment 110, stops supplying refrigerants to the refrigeration cycle of the first storage compartment 110, and/or stops supplying cold air to the first storage compartment 110. In this case, the heater 150 is in a heating circle state. The non-refrigeration stage is illustrated as "Non-Refrigerating" of stages 2 to 7 in FIG. 5.

A heating cycle of the heater 150 includes a waiting stage, a heating stage, and a heating stop stage.

In the waiting stage, the refrigeration system starts to stop cooling the first storage compartment 110; and the heater 150 does not work in a waiting duration after the refrigeration system starts to stop cooling, and the heater 150 starts to work after the waiting duration ends. The waiting stage is illustrated as "Waiting" of stage 2 in FIG. 5.

When the refrigeration system just stops cooling, the existing air with a relatively high humidity in the first storage compartment 110 is still being exchanged with the inputted cold air, and the humidity of the air in the first storage compartment 110 is still in a decreasing stage. In this case, the possibility of condensation is relatively low. Therefore, after a waiting duration, during which the humidity of the air in the first storage compartment 110 gradually rises, the heater 150 starts to work when the possibility of condensation is relatively high, which can not only improve the utilization efficiency of the heater 150, but also save energy.

In the heating stage, the heater 150 does not heat the surface 131 of the separation wall 130 facing the first storage compartment 110 until at least a waiting duration ends. The heating stage is illustrated as "On" of stages 3, 5 and 7 in FIG. 5.

In the heating stop stage, the heater 150 stops heating the surface 131 of the separation wall 130 facing the first storage compartment 110 after the heating stage. The heating stop stage is illustrated as "Off" of stages 4 and 6 in FIG. 5.

The heater 150 is controlled to work intermittently, which can improve the service life of the heater 150 compared to making the heater 150 work continuously.

Parameters related to intermittent work may be selectively adjusted according to different scenarios or requirements, including a waiting duration, a duration of each heating stage, a duration of each heating stop stage, an operating duty cycle (that is, a ratio of a total duration of heating stages to a total duration of heating stop stages in a heating cycle), and an output power of the heater 150 in the heating stage.

Specifically, in the anti-condensation mode, a waiting duration, an operating duty cycle, and/or an output power (that is, a power of the heater 150 during normal operation in the heating stage) of the heater 150 may be determined based on at least one of the set temperature of the first storage compartment 110, the detected temperature of the first storage compartment 110, the first difference between the set temperature of the first storage compartment 110 and the set temperature of the second storage compartment 120, the second difference between the detected temperature of the first storage compartment 110 and the detected temperature of the second storage compartment 120, an ambient temperature around the refrigerator 100, or an ambient humidity around the refrigerator 100. Further, based on the waiting duration, the operating duty cycle, and/or the output power, the heater 150 is controlled to work in the anti-condensation mode when the refrigeration system stops cooling the first storage compartment 110, to heat the surface 131 of the separation wall 130 facing the first storage compartment 110.

In this embodiment of the present invention, the waiting duration, the operating duty cycle, and/or the output power of the heater 150 may be determined based on a temperature difference range within which the first difference or the second difference falls.

The means (for example, the waiting duration, the operating duty cycle, and/or the output power of the heater 150) of resolving condensation are directly correlated with the related causes of condensation (for example, the first difference and the second difference between the first storage compartment and the second storage compartment 120 with respect to the temperature difference), so that condensation can be prevented easily and effectively.

In a specific implementation, the temperature difference range may be divided into a plurality of temperature difference sub-ranges; and the waiting duration of the heater 150 may be determined based on a temperature difference sub-range within which the first difference or the second difference falls, where a temperature difference sub-range with a higher temperature difference corresponds to a shorter waiting duration of the heater 150 than a temperature difference sub-range with a lower temperature difference.

Different waiting durations of the heater 150 correspond to different temperature difference sub-ranges, which can effectively prevent condensation.

In a specific implementation, the temperature difference range may be divided into a plurality of temperature difference sub-ranges; and the operating duty cycle and/or the output power of the heater 150 may be determined based on a temperature difference sub-range within which the first difference or the second difference falls, where a temperature difference sub-range with a higher temperature difference corresponds to a higher operating duty cycle and/or a higher output power of the heater 150 than a temperature difference sub-range with a lower temperature difference.

Different operating duty cycles and/or output powers of the heater 150 correspond to different temperature difference sub-ranges, which can effectively prevent condensation.

In this embodiment of the present invention, the waiting duration, the operating duty cycle, and/or the output power of the heater 150 may be determined based on an ambient temperature range within which the ambient temperature falls or an ambient humidity range within which the ambient humidity falls. The ambient temperature and the ambient humidity may be respectively detected by the ambient temperature sensor 173 and the ambient humidity sensor 174 of the refrigerator 100.

In a specific implementation, the ambient temperature range may be divided into a plurality of ambient temperature sub-ranges; and the waiting duration of the heater 150 may be determined based on an ambient temperature sub-range within which the ambient temperature falls, where an ambient temperature sub-range with a higher temperature corresponds to a longer waiting duration of the heater 150 than an ambient temperature sub-range with a lower temperature.

Specifically, when the refrigerator 100 is in an ambient temperature sub-range with a higher temperature, the operating rate of the refrigerator may increase, a frequency and/or a duration of cold air exchange in the first storage compartment 110 may increase, and the humidity of the air in the first storage compartment 110 may decrease, thereby reducing the probability of condensation. Therefore, an ambient temperature sub-range with a higher temperature may correspond to a longer waiting duration of the heater 150 than an ambient temperature sub-range with a lower temperature.

Different waiting durations of the heater 150 correspond to different ambient temperature sub-ranges, which can effectively prevent condensation.

In a specific implementation, the ambient temperature range may be divided into a plurality of ambient temperature sub-ranges; and the operating duty cycle and/or the output power of the heater 150 may be determined based on an ambient temperature sub-range within which the ambient temperature falls, where an ambient temperature sub-range with a higher temperature corresponds to a lower operating duty cycle and/or a lower output power of the heater 150 than an ambient temperature sub-range with a lower temperature.

Specifically, when the refrigerator 100 is in an ambient temperature sub-range with a higher temperature, the operating rate of the refrigerator may increase, a frequency and/or a duration of cold air exchange in the first storage compartment 110 increase, and the humidity of the air in the first storage compartment 110 decreases, thereby reducing the probability of condensation. Therefore, an ambient temperature sub-range with a higher temperature may correspond to a lower operating duty cycle and/or a lower output power of the heater 150 than an ambient temperature sub-range with a lower temperature.

Different operating duty cycles and/or output powers of the heater 150 correspond to different ambient temperature sub-ranges, which can effectively prevent condensation.

In a specific implementation, the ambient temperature sub-range may be greater than or equal to a first temperature and less than or equal to a second temperature; and if the ambient temperature is greater than or equal to a difference of the first temperature minus a buffer value and less than or equal to a sum of the second temperature plus the buffer value, determining that the ambient temperature is within the ambient temperature sub-range, the buffer value being greater than or equal to 0° C.

For example, the buffer value is selected from a range of 0.5 to 2° C.

Setting the buffer value can avoid frequently determining that the ambient temperature is in different ambient temperature sub-ranges because the ambient temperature randomly enters different ambient temperature sub-ranges when fluctuating at boundaries of the ambient temperature sub-ranges, thereby avoiding frequent switching of the heater 150 between different working modes based on different ambient temperature sub-ranges (for example, different waiting durations, different operating duty cycles, and different output powers), and improving the service life of the heater 150.

In a specific implementation, the ambient humidity range may be divided into a plurality of ambient humidity sub-ranges; and the waiting duration of the heater 150 may be determined based on an ambient humidity sub-range within which the ambient humidity falls, where an ambient humidity sub-range with a higher humidity corresponds to a shorter waiting duration of the heater 150 than an ambient humidity sub-range with a lower humidity.

Different waiting durations of the heater 150 correspond to different ambient humidity sub-ranges, which can effectively prevent condensation.

In a specific implementation, the ambient humidity range may be divided into a plurality of ambient humidity sub-ranges; and the operating duty cycle and/or the output power of the heater 150 may be determined based on an ambient humidity sub-range within which the ambient humidity falls, where an ambient humidity sub-range with a higher humidity corresponds to a higher operating duty cycle and/or a higher output power of the heater 150 than an ambient humidity sub-range with a lower humidity.

Different operating duty cycles and/or output powers of the heater 150 correspond to different ambient humidity sub-ranges, which can effectively prevent condensation.

In some embodiments of the present invention, the first storage compartment 110 is a refrigerating compartment, and the second storage compartment 120 is a freezing compartment.

Working parameters of the heater 150 may be determined based on a temperature difference sub-range within which the first differences with respect to the set temperatures or the second differences with respect to the detected temperatures of the refrigerating compartment and the freezing compartment falls, such as a waiting duration (Waiting), a duration (On) of heating in each cycle when the heater 150 works intermittently, and a duration (Off) of heating stop.

As shown in Table 1, the first differences or the second differences in the first column correspond to the working parameters of the heater 150 in the second to fourth columns.

TABLE 1

| First/Second difference (° C.) | Waiting (min) | On (min) | Off (min) |
|---|---|---|---|
| less than 4 | 60 ± 0.5 | 1 ± 0.2 | 30 ± 0.5 |
| greater than or equal to 4 and less than 8 | 30 ± 0.5 | 1 ± 0.2 | 20 ± 0.5 |
| greater than or equal to 8 and less than 12 | 10 ± 0.5 | 1 ± 0.2 | 3 ± 0.5 |
| greater than or equal to 12 and less than 18 | 5 ± 0.5 | 1 ± 0.2 | 2 ± 0.5 |
| greater than or equal to 18 | 2 ± 0.5 | 1 ± 0.2 | 1 ± 0.5 |

The ambient temperature range may be divided into a plurality of ambient temperature sub-ranges, and working parameters of the heater 150 may be determined based on an ambient temperature sub-range within which the ambient temperature falls, such as a waiting duration, a duration of heating in each cycle when the heater 150 works intermittently, and a duration of heating stop.

As shown in Table 2, the ambient temperature sub-ranges in the first column correspond to the working parameters of the heater 150 in the second to fourth columns.

TABLE 2

| Ambient temperature sub-range (° C.) | Waiting (min) | On (min) | Off (min) |
|---|---|---|---|
| less than 8 | 5 ± 0.5 | 2 ± 0.2 | 2 ± 0.5 |
| greater than or equal to 8 and less than 13 | 6 ± 0.5 | 2 ± 0.2 | 3 ± 0.5 |
| greater than or equal to 13 and less than 20 | 7 ± 0.5 | 2 ± 0.2 | 4 ± 0.5 |
| greater than or equal to 20 and less than 29 | 10 ± 0.5 | 2 ± 0.2 | 5 ± 0.5 |
| greater than or equal to 29 and less than 35 | 12 ± 0.5 | 2 ± 0.2 | 6 ± 0.5 |
| greater than or equal to 35 and less than 40 | 15 ± 0.5 | 2 ± 0.2 | 7 ± 0.5 |
| greater than or equal to 40 | 18 ± 0.5 | 2 ± 0.2 | 8 ± 0.5 |

The ambient humidity range may be divided into a plurality of ambient humidity sub-ranges, and working parameters of the heater 150 may be determined based on an ambient humidity sub-range within which the ambient humidity falls, such as a waiting duration, a duration of heating in each cycle when the heater 150 works intermittently, and a duration of heating stop.

As shown in Table 3, the ambient humidity sub-ranges in the first column correspond to the working parameters of the heater 150 in the second to fourth columns.

TABLE 3

| Ambient humidity sub-range | Waiting (min) | On (min) | Off (min) |
|---|---|---|---|
| less than 10% | 60 ± 0.5 | 1 ± 0.2 | 20 ± 0.5 |
| greater than or equal to 10% and less than 20% | 50 ± 0.5 | 1 ± 0.2 | 18 ± 0.5 |
| greater than or equal to 20% and less than 30% | 45 ± 0.5 | 1 ± 0.2 | 16 ± 0.5 |
| greater than or equal to 30% and less than 40% | 40 ± 0.5 | 1 ± 0.2 | 14 ± 0.5 |
| greater than or equal to 40% and less than 50% | 35 ± 0.5 | 1 ± 0.2 | 12 ± 0.5 |
| greater than or equal to 50% and less than 60% | 30 ± 0.5 | 1 ± 0.2 | 10 ± 0.5 |
| greater than or equal to 60% and less than 70% | 25 ± 0.5 | 1 ± 0.2 | 8 ± 0.5 |
| greater than or equal to 70% and less than 80% | 20 ± 0.5 | 1 ± 0.2 | 6 ± 0.5 |
| greater than or equal to 80% and less than 90% | 10 ± 0.5 | 1 ± 0.2 | 5 ± 0.5 |
| greater than or equal to 90% and less than or equal to 100% | 5 ± 0.5 | 1 ± 0.2 | 4 ± 0.5 |

In some other embodiments of the present invention, the first storage compartment 110 is a refrigerating compartment, and the second storage compartment 120 is a variable-temperature compartment.

Working parameters of the heater 150 may be determined based on a temperature difference sub-range within which the first differences with respect to the set temperatures or the second differences with respect to the detected temperatures of the refrigerating compartment and the variable-temperature compartment falls, such as a waiting duration, a duration of heating in each cycle when the heater 150 works intermittently, and a duration of heating stop.

As shown in Table 4, the first differences or the second differences in the first column correspond to the working parameters of the heater 150 in the second to fourth columns.

TABLE 4

| First/Second difference (° C.) | Waiting (min) | On (min) | Off (min) |
|---|---|---|---|
| less than 2 | 60 ± 0.5 | 1 ± 0.2 | 60 ± 0.5 |
| greater than or equal to 2 and less than 4 | 60 ± 0.5 | 1 ± 0.2 | 30 ± 0.5 |
| greater than or equal to 4 and less than 8 | 30 ± 0.5 | 1 ± 0.2 | 20 ± 0.5 |
| greater than or equal to 8 and less than 12 | 10 ± 0.5 | 1 ± 0.2 | 3 ± 0.5 |
| greater than or equal to 12 and less than 18 | 5 ± 0.5 | 1 ± 0.2 | 2 ± 0.5 |
| greater than or equal to 18 | 2 ± 0.5 | 1 ± 0.2 | 1 ± 0.5 |

The ambient temperature range may be divided into a plurality of ambient temperature sub-ranges, and working parameters of the heater 150 may be determined based on an ambient temperature sub-range within which the ambient temperature falls, such as a waiting duration, a duration of heating in each cycle when the heater 150 works intermittently, and a duration of heating stop.

As shown in Table 5, the ambient temperature sub-ranges in the first column correspond to the working parameters of the heater 150 in the second to fourth columns.

TABLE 5

| Ambient temperature sub-range (° C.) | Waiting (min) | On (min) | Off (min) |
|---|---|---|---|
| less than 8 | 5 ± 0.5 | 2 ± 0.2 | 2 ± 0.5 |
| greater than or equal to 8 and less than 13 | 6 ± 0.5 | 2 ± 0.2 | 3 ± 0.5 |
| greater than or equal to 13 and less than 20 | 7 ± 0.5 | 2 ± 0.2 | 4 ± 0.5 |
| greater than or equal to 20 and less than 29 | 10 ± 0.5 | 2 ± 0.2 | 5 ± 0.5 |
| greater than or equal to 29 and less than 35 | 12 ± 0.5 | 2 ± 0.2 | 6 ± 0.5 |
| greater than or equal to 35 and less than 40 | 15 ± 0.5 | 2 ± 0.2 | 7 ± 0.5 |
| greater than or equal to 40 | 18 ± 0.5 | 2 ± 0.2 | 8 ± 0.5 |

The ambient humidity range may be divided into a plurality of ambient humidity sub-ranges, and working parameters of the heater 150 may be determined based on an ambient humidity sub-range within which the ambient humidity falls, such as a waiting duration, a duration of heating in each cycle when the heater 150 works intermittently, and a duration of heating stop.

As shown in Table 6, the ambient humidity sub-ranges in the first column correspond to the working parameters of the heater 150 in the second to fourth columns.

TABLE 6

| Ambient humidity sub-range | Waiting (min) | On (min) | Off (min) |
|---|---|---|---|
| less than 10% | 60 ± 0.5 | 1 ± 0.2 | 20 ± 0.5 |
| greater than or equal to 10% and less than 20% | 50 ± 0.5 | 1 ± 0.2 | 18 ± 0.5 |
| greater than or equal to 20% and less than 30% | 45 ± 0.5 | 1 ± 0.2 | 16 ± 0.5 |
| greater than or equal to 30% and less than 40% | 40 ± 0.5 | 1 ± 0.2 | 14 ± 0.5 |
| greater than or equal to 40% and less than 50% | 35 ± 0.5 | 1 ± 0.2 | 12 ± 0.5 |
| greater than or equal to 50% and less than 60% | 30 ± 0.5 | 1 ± 0.2 | 10 ± 0.5 |
| greater than or equal to 60% and less than 70% | 25 ± 0.5 | 1 ± 0.2 | 8 ± 0.5 |

TABLE 6-continued

| Ambient humidity sub-range | Waiting (min) | On (min) | Off (min) |
|---|---|---|---|
| greater than or equal to 70% and less than 80% | 20 ± 0.5 | 1 ± 0.2 | 6 ± 0.5 |
| greater than or equal to 80% and less than 90% | 10 ± 0.5 | 1 ± 0.2 | 5 ± 0.5 |
| greater than or equal to 90% and less than or equal to 100% | 5 ± 0.5 | 1 ± 0.2 | 4 ± 0.5 |

In some other embodiments of the present invention, the first storage compartment 110 is a variable-temperature compartment, and the second storage compartment 120 is a freezing compartment.

Working parameters of the heater 150 may be determined based on a temperature difference sub-range within which the first difference with respect to the set temperatures or the second difference with respect to the detected temperatures of the variable-temperature compartment and the freezing compartment falls, such as a waiting duration, a duration of heating in each cycle when the heater 150 works intermittently, and a duration of heating stop.

As shown in Table 7, the first differences or the second differences in the first column correspond to the working parameters of the heater 150 in the second to fourth columns.

TABLE 7

| First/Second difference (° C.) | Waiting (min) | On (min) | Off (min) |
|---|---|---|---|
| less than 2 | 60 ± 0.5 | 1 ± 0.2 | 60 ± 0.5 |
| greater than or equal to 2 and less than 4 | 60 ± 0.5 | 1 ± 0.2 | 20 ± 0.5 |
| greater than or equal to 4 and less than 8 | 30 ± 0.5 | 1 ± 0.2 | 10 ± 0.5 |
| greater than or equal to 8 and less than 12 | 10 ± 0.5 | 1 ± 0.2 | 2 ± 0.5 |
| greater than or equal to 12 and less than 18 | 5 ± 0.5 | 1 ± 0.2 | 1 ± 0.5 |
| greater than or equal to 18 | 2 ± 0.5 | 2 ± 0.2 | 1 ± 0.5 |

In an embodiment, working parameters of the heater 150 are determined based on a temperature range within which the set temperature of the variable-temperature compartment falls, such as a waiting duration, a duration of heating in each cycle when the heater 150 works intermittently, and a duration of heating stop. Since the set temperature of the freezing compartment is usually a fixed temperature, the working parameters may be determined only based on the temperature range within which the set temperature of the variable-temperature compartment falls, thereby simplifying the implementation of the solution.

The ambient temperature range may be divided into a plurality of ambient temperature sub-ranges, and working parameters of the heater 150 may be determined based on an ambient temperature sub-range within which the ambient temperature falls, such as a waiting duration, a duration of heating in each cycle when the heater 150 works intermittently, and a duration of heating stop.

As shown in Table 8, the ambient temperature sub-ranges in the first column correspond to the working parameters of the heater 150 in the second to fourth columns.

TABLE 8

| Ambient temperature sub-range (° C.) | Waiting (min) | On (min) | Off (min) |
|---|---|---|---|
| less than 8 | 5 ± 0.5 | 2 ± 0.2 | 2 ± 0.5 |
| greater than or equal to 8 and less than 13 | 6 ± 0.5 | 2 ± 0.2 | 3 ± 0.5 |
| greater than or equal to 13 and less than 20 | 7 ± 0.5 | 2 ± 0.2 | 4 ± 0.5 |
| greater than or equal to 20 and less than 29 | 10 ± 0.5 | 2 ± 0.2 | 5 ± 0.5 |
| greater than or equal to 29 and less than 35 | 12 ± 0.5 | 2 ± 0.2 | 6 ± 0.5 |
| greater than or equal to 35 and less than 40 | 15 ± 0.5 | 2 ± 0.2 | 7 ± 0.5 |
| greater than or equal to 40 | 18 ± 0.5 | 2 ± 0.2 | 8 ± 0.5 |

The ambient humidity range may be divided into a plurality of ambient humidity sub-ranges, and working parameters of the heater 150 may be determined based on an ambient humidity sub-range within which the ambient humidity falls, such as a waiting duration, a duration of heating in each cycle when the heater 150 works intermittently, and a duration of heating stop.

As shown in Table 9, the ambient humidity sub-ranges in the first column correspond to the working parameters of the heater 150 in the second to fourth columns.

TABLE 9

| Ambient humidity sub-range | Waiting (min) | On (min) | Off (min) |
|---|---|---|---|
| less than 10% | 60 ± 0.5 | 1 ± 0.2 | 20 ± 0.5 |
| greater than or equal to 10% and less than 20% | 50 ± 0.5 | 1 ± 0.2 | 16 ± 0.5 |
| greater than or equal to 20% and less than 30% | 45 ± 0.5 | 1 ± 0.2 | 14 ± 0.5 |
| greater than or equal to 30% and less than 40% | 40 ± 0.5 | 1 ± 0.2 | 12 ± 0.5 |
| greater than or equal to 40% and less than 50% | 35 ± 0.5 | 1 ± 0.2 | 10 ± 0.5 |
| greater than or equal to 50% and less than 60% | 30 ± 0.5 | 1 ± 0.2 | 8 ± 0.5 |
| greater than or equal to 60% and less than 70% | 25 ± 0.5 | 1 ± 0.2 | 6 ± 0.5 |
| greater than or equal to 70% and less than 80% | 20 ± 0.5 | 1 ± 0.2 | 5 ± 0.5 |
| greater than or equal to 80% and less than 90% | 10 ± 0.5 | 1 ± 0.2 | 4 ± 0.5 |
| greater than or equal to 90% and less than or equal to 100% | 5 ± 0.5 | 1 ± 0.2 | 3 ± 0.5 |

Although specific implementations are described above, the implementations are not intended to limit the scope disclosed in the present invention, even if only a single implementation is described relative to a specific feature. The feature examples provided in the present invention are intended to be illustrative rather than restrictive, unless different expressions are made. In a specific implementation, according to an actual requirement, in a technically feasible case, the technical features of one or more dependent claims may be combined with the technical features of the independent claims, and the technical features from the corresponding independent claims may be combined in any appropriate way instead of using just specific combinations listed in the claims.

Although the present invention is disclosed above, the present invention is not limited thereto. Any person skilled in the art can make various changes and modifications without departing from the spirit and the scope of the present invention. Therefore, the protection scope of the present invention should be subject to the scope defined by the claims.

What is claimed is:

1. An anti-condensation method for a refrigerator, wherein the refrigerator has a first storage compartment, a second storage compartment adjacent the first storage compartment, a separation wall separating the first storage compartment and the second storage compartment, and a heater located in the separation wall;

the anti-condensation method comprising:

selectively setting the first storage compartment to a refrigerating temperature, and setting the second storage compartment to a freezing temperature; and controlling the heater to work in an anti-condensation mode when a refrigeration system stops cooling the first storage compartment, to heat a wall surface of the separation wall facing the first storage compartment; and when a set temperature of the first storage compartment is higher than a first preset value or a detected temperature of the first storage compartment is higher than a second preset value, controlling the heater to work in the anti-condensation mode when the refrigeration system stops cooling the first storage compartment, to heat the surface of the separation wall facing the first storage compartment.

2. The anti-condensation method according to claim 1, which comprises, when a first difference between a set temperature of the first storage compartment and a set temperature of the second storage compartment is higher than a third preset value or a second difference between a detected temperature of the first storage compartment and a detected temperature of the second storage compartment is higher than a fourth preset value, controlling the heater to work in the anti-condensation mode when the refrigeration system stops cooling the first storage compartment, to heat the surface of the separation wall facing the first storage compartment.

3. The anti-condensation method according to claim 1, which comprises:

acquiring an operating rate of the first storage compartment; and when the operating rate is less than a given preset value, controlling the heater to work in the anti-condensation mode when the refrigeration system stops cooling the first storage compartment, to heat the surface of the separation wall facing the first storage compartment.

4. The anti-condensation method according to claim 1, which comprises:

acquiring a frequency at which a door of the first storage compartment is opened; and when the frequency is greater than a given preset value, controlling the heater to work in the anti-condensation mode when the refrigeration system stops cooling the first storage compartment, to heat the surface of the separation wall facing the first storage compartment.

5. The anti-condensation method according to claim 1, which comprises controlling the heater in the anti-condensation mode to work intermittently to heat the surface of the separation wall facing the first storage compartment.

6. The anti-condensation method according to claim 1, which comprises, after the refrigeration system stops cooling the first storage compartment, starting the heater after a given delay duration.

7. The anti-condensation method according to claim 1, which comprises, in the anti-condensation mode, determining at least one of a delay duration, an operating duty cycle, or an output power of the heater according to at least one of a set temperature of the first storage compartment, a detected temperature of the first storage compartment, a first difference between the set temperature of the first storage compartment and a set temperature of the second storage compartment, a second difference between the detected temperature of the first storage compartment and a detected temperature of the second storage compartment, an ambient temperature around the refrigerator, or an ambient humidity around the refrigerator.

8. The anti-condensation method according to claim 7, which comprises determining at least one of the delay duration, the operating duty cycle, or the output power of the heater based on a temperature difference range within which the first difference or the second difference falls.

9. The anti-condensation method according to claim 8, which comprises:

dividing the temperature difference range into a plurality of temperature difference sub-ranges; and determining the delay duration of the heater based on a temperature difference sub-range within which the first difference or the second difference falls;

wherein a temperature difference sub-range with a higher temperature difference corresponds to a shorter delay duration of the heater than a temperature difference sub-range with a lower temperature difference.

10. The anti-condensation method according to claim 8, which comprises:

dividing the temperature difference range into a plurality of temperature difference sub-ranges; and determining the operating duty cycle and/or the output power of the heater based on a temperature difference sub-range within which the first difference or the second difference falls;

wherein a temperature difference sub-range with a higher temperature difference corresponds to a higher operating duty cycle and/or a higher output power of the heater than a temperature difference sub-range with a lower temperature difference.

11. The anti-condensation method according to claim 7, which comprises determining at least one of the delay duration, the operating duty cycle, or the output power of the heater based on an ambient temperature range within which the ambient temperature falls or based on an ambient humidity range within which the ambient humidity falls.

12. The anti-condensation method according to claim 11, which comprises:

dividing the ambient temperature range into a plurality of ambient temperature sub-ranges; and determining the delay duration of the heater based on an ambient temperature sub-range within which the ambient temperature falls;

wherein an ambient temperature sub-range with a higher temperature corresponds to a longer waiting duration of the heater than an ambient temperature sub-range with a lower temperature.

13. A refrigerator, which comprises:

a first storage compartment configured to operate at a refrigeration temperature within a settable temperature range;

a second storage compartment, adjacent said first storage compartment and configured to operate at a freezing temperature within a settable temperature range;

a separation wall disposed to separate said first storage compartment from said second storage compartment;

a refrigeration system configured to cool at least said first storage compartment;

a heater in said separation wall; and a controller connected to said heater and configured to perform the anti-condensation method according to claim 1.

14. The refrigerator according to claim 13, wherein:

said first storage compartment is a variable-temperature compartment, and said second storage compartment is a freezing compartment; or said first storage compartment is a refrigerating compartment, and said second storage compartment is a freezing compartment or a variable-temperature compartment.

15. An anti-condensation method for a refrigerator, wherein the refrigerator has a first storage compartment, a second storage compartment adjacent the first storage compartment, a separation wall separating the first storage compartment and the second storage compartment, and a heater located in the separation wall;

the anti-condensation method comprising:

selectively setting the first storage compartment to a refrigerating temperature, and setting the second storage compartment to a freezing temperature; and controlling the heater to work in an anti-condensation mode when a refrigeration system stops cooling the first storage compartment, to heat a wall surface of the separation wall facing the first storage compartment; and when a first difference between a set temperature of the first storage compartment and a set temperature of the second storage compartment is higher than a third preset value or a second difference between a detected temperature of the first storage compartment and a detected temperature of the second storage compartment is higher than a fourth preset value, controlling the heater to work in the anti-condensation mode when the refrigeration system stops cooling the first storage compartment, to heat the surface of the separation wall facing the first storage compartment.

16. An anti-condensation method for a refrigerator, wherein the refrigerator has a first storage compartment, a second storage compartment adjacent the first storage compartment, a separation wall separating the first storage compartment and the second storage compartment, and a heater located in the separation wall;

the anti-condensation method comprising:

selectively setting the first storage compartment to a refrigerating temperature, and setting the second storage compartment to a freezing temperature; and controlling the heater to work in an anti-condensation mode when a refrigeration system stops cooling the first storage compartment, to heat a wall surface of the separation wall facing the first storage compartment; and acquiring a frequency at which a door of the first storage compartment is opened, and when the frequency is greater than a given preset value, controlling the heater to work in the anti-condensation mode when the refrigeration system stops cooling the first storage compartment, to heat the surface of the separation wall facing the first storage compartment.

* * * * *